US006802750B2

(12) United States Patent
Hellmann

(10) Patent No.: US 6,802,750 B2
(45) Date of Patent: Oct. 12, 2004

(54) EXHAUST SYSTEM FOR WATERCRAFT

(75) Inventor: Hans Kurt Hellmann, Schwanewede (DE)

(73) Assignee: Fr. Lurssen Werft (GmbH & Co.), Bremen (DE)

( * ) Notice: Subject to any disclaimer, the term of this patent is extended or adjusted under 35 U.S.C. 154(b) by 143 days.

(21) Appl. No.: 10/221,257

(22) PCT Filed: Feb. 8, 2001

(86) PCT No.: PCT/EP01/01345

§ 371 (c)(1),
(2), (4) Date: Dec. 16, 2002

(87) PCT Pub. No.: WO01/69053

PCT Pub. Date: Sep. 20, 2001

(65) Prior Publication Data

US 2003/0143903 A1 Jul. 31, 2003

(30) Foreign Application Priority Data

Mar. 10, 2000 (DE) ..... 100 11 806

(51) Int. Cl.[7] ..... B63H 21/32
(52) U.S. Cl. ..... 440/89 B; 181/221; 440/89 E
(58) Field of Search ..... 440/89 R, 89 B, 440/89 C, 89 E, 89 F; 181/221

(56) References Cited

U.S. PATENT DOCUMENTS 6,412,595 B1 * 7/2002 Horak et al. ..... 181/221

FOREIGN PATENT DOCUMENTS

| | | |
|---|---|---|
| CH | 142333 | 9/1930 |
| DE | 37 43 798 A1 | 7/1989 |
| DE | 44 03 405 A1 | 8/1995 |
| GB | 28392 | 9/1912 |
| WO | 97/23383 | 7/1997 |

* cited by examiner

*Primary Examiner*—Jesus D. Sotelo
(74) *Attorney, Agent, or Firm*—Wood, Herron & Evans, L.L.P.

(57) ABSTRACT

The invention relates to an exhaust system for watercraft, having an exhaust pipe which leads from an engine system to an exhaust gas outlet, wherein a through-flow means for degrading the energy of seawater gushing through the exhaust gas outlet into said exhaust pipe is provided in the section of said exhaust pipe preceding the exhaust gas outlet, and that at least one settling basin is provided in the area of said means for degrading the energy of seawater, or upstream thereof in the direction of exhaust gas flow, and a drainage conduit leads from the deepest point of the settling basin into the surroundings of the vessel.

18 Claims, 4 Drawing Sheets

EXHAUST SYSTEM FOR WATERCRAFT

Figure 1:
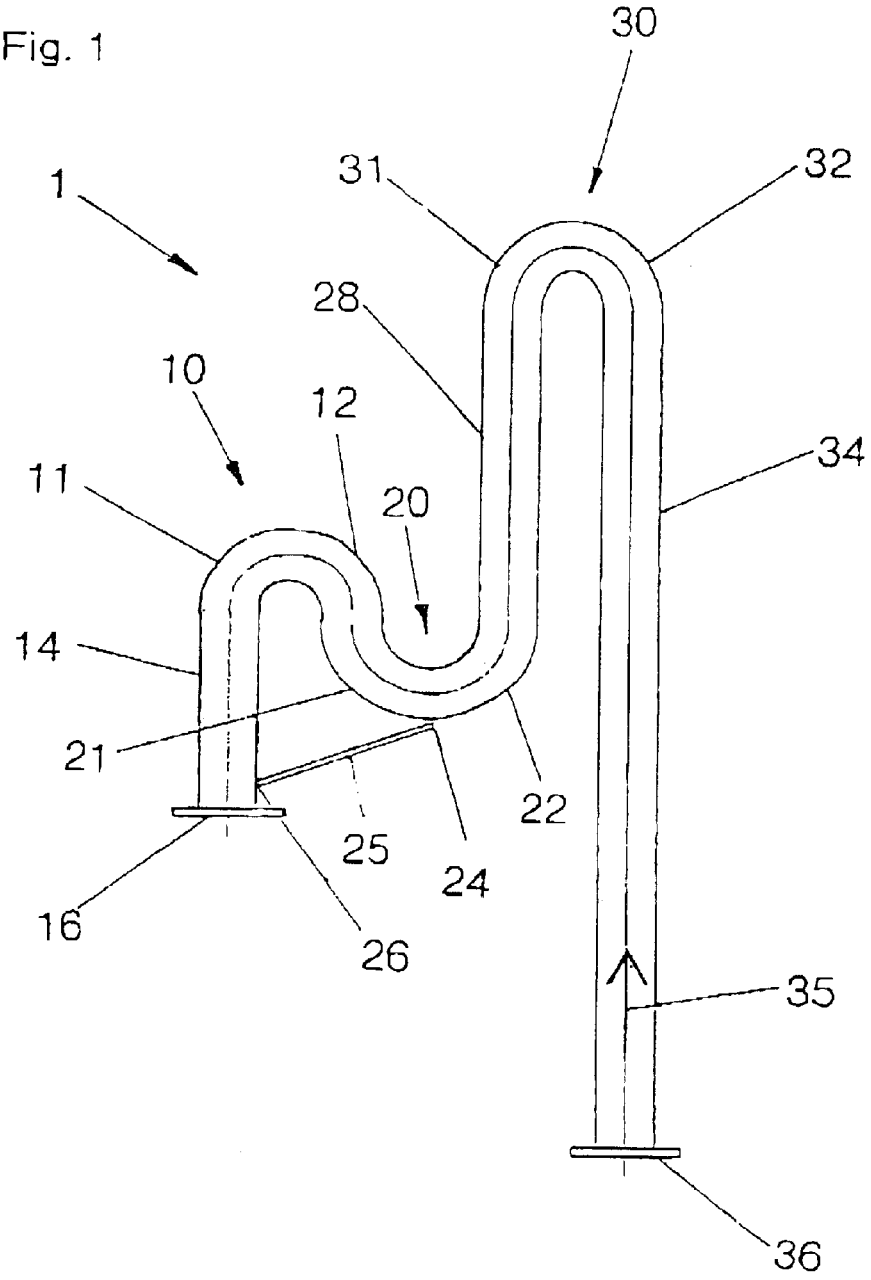

Exhaust systems for smaller and medium-sized watercraft generally include, in the direction of flow of the exhaust gases downstream from the engine or engines, one or more compensators for damping the vibrations, silencers and an exhaust pipe that leads to an outlet in the side of the watercraft. Said outlet is typically located just above the waterline, in order to keep the discharged exhaust gases as far away as possible from the deck of the watercraft and from the decks of neighboring watercraft.

Due to the high temperature of the exhaust gases, it is necessary that they be cooled before passing through the side of the vessel. This is usually done by injecting seawater directly into the exhaust pipe, said water then being swirled with the flow of exhaust gases and ejected with the latter through the exhaust pipe.

This way of cooling the exhaust gases is very efficient. One problem with it, however, is that, due to direct contact between the seawater and the exhaust gases, and the relatively long duration of this contact throughout the entire transport path to the outlet, uncombusted fuel and soot particles are deposited in the cooling water and flushed out from the exhaust pipe along with the water. As a consequence, a film of soot and fuel particles is formed on the water surface around the outlet, on the side of the vessel and on neighboring watercraft.

Another consequence of seawater being injected directly into the exhaust pipe is that the exhaust pipe is clearly susceptible to corrosion in the area around the seawater injection duct.

Another problem with unpleasant consequences for the exhaust system is the beating of waves; when heavy seas or swell leads to water masses beating against the side of the vessel in the area of the outlet opening, thus penetrating into the exhaust system, this can lead to substantial damage. In order to avoid such damage as far as possible, a known method is to have the exhaust pipe describe a U-shape shortly before the outlet, and to have the vertex of the U positioned as high as possible above the water surface. However, it has become evident that, under unfavorable conditions, this precautionary arrangement is not sufficient, either, for seawater that has been washed into the system to be stopped before reaching the vertex of the U. If seawater does penetrate beyond said vertex, considerable damage to the compensators, the silencer or to the engine as a result of corrosion is pre-programmed.

The object of the invention is, therefore, to provide an exhaust system for watercraft in which corrosion damage from seawater is largely prevented.

In accordance with the invention, that object is attained with an exhaust system for watercraft that has an exhaust pipe leading from an engine system to an exhaust gas outlet, wherein a through-flow means for degrading the energy of seawater gushing through the exhaust gas outlet into said exhaust pipe is provided in the section of said exhaust pipe preceding the exhaust gas outlet, and that at least one settling basin is provided in the area of said means for degrading the energy of seawater, or upstream thereof in the direction of exhaust gas flow, and a drainage conduit leads from the deepest point of the settling basin into the surroundings of the vessel.

An advantageous embodiment is one in which the settling basin is disposed higher than the exhaust gas outlet.

A further advantageous embodiment is one in which the means for energy degradation is defined by at least one elbow in, and the settling basin by a section of the exhaust pipe that is located between a downward section and a subsequent upward section of said exhaust pipe.

In the latter case, the elbow in the pipe is preferably defined by two 180° bends that curve in the same direction along a helix and hence can be installed in a space-saving manner. It is then advantageous when the first bend closest to the exhaust gas outlet when viewed contrary to the direction of exhaust gas flow is comprised of a first upward branch and a second downward branch, and that the second bend following thereafter defines the settling basin and commences with a first downward branch and ends with a second upward branch.

In an exhaust system in which the exhaust gases are cooled with seawater, the place where cooling seawater is fed into the exhaust gas is preferably located downstream from the first bend. This proves to be particularly advantageous when the end member at the outlet end of the exhaust pipe is at least partially enclosed in a cooling-water jacket.

Figure 2:
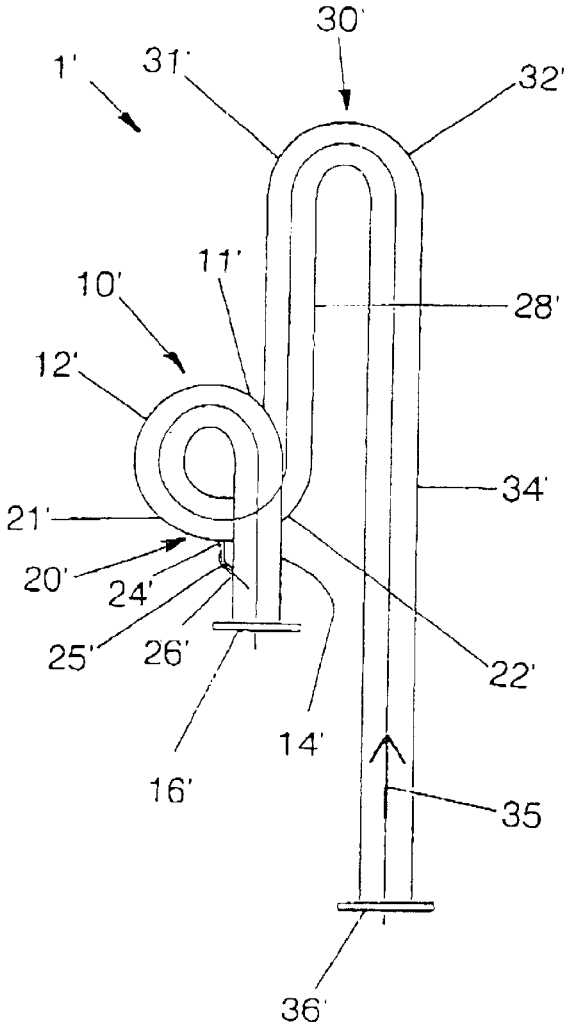
Figure 3:
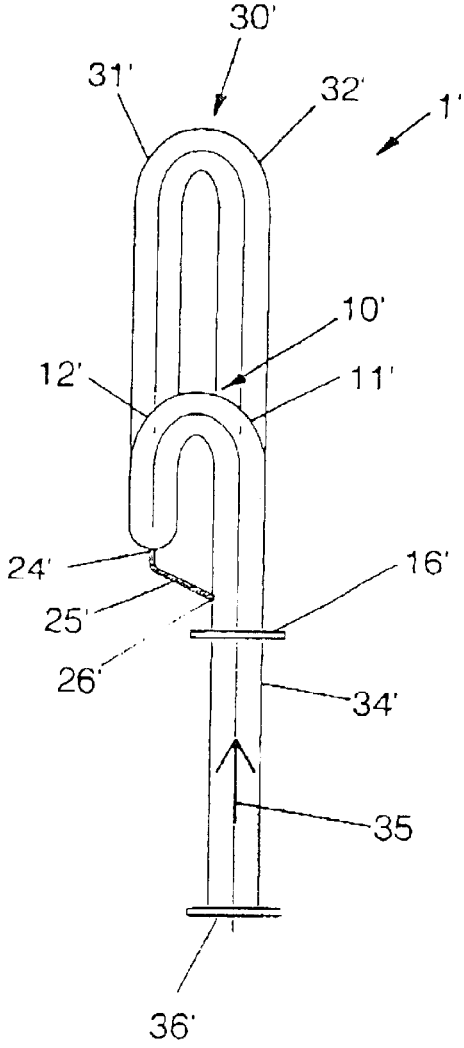
Figure 5:
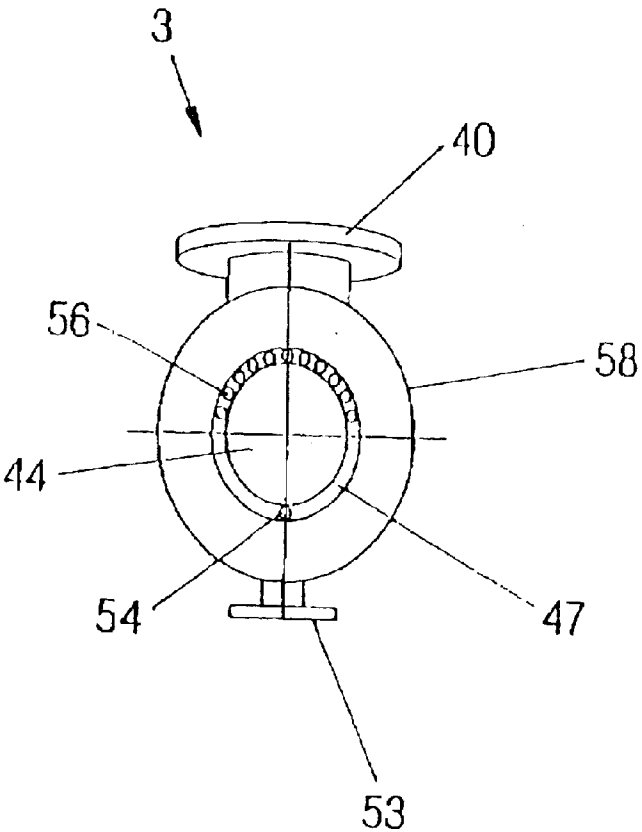
Figure 4:
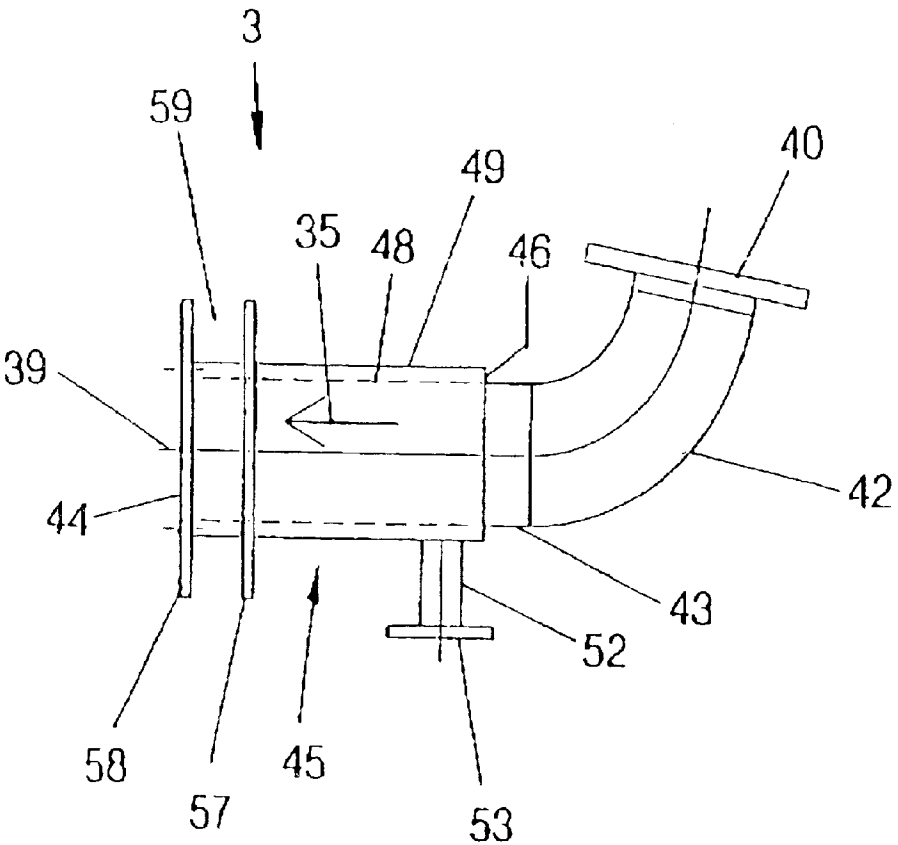
Figure 6:
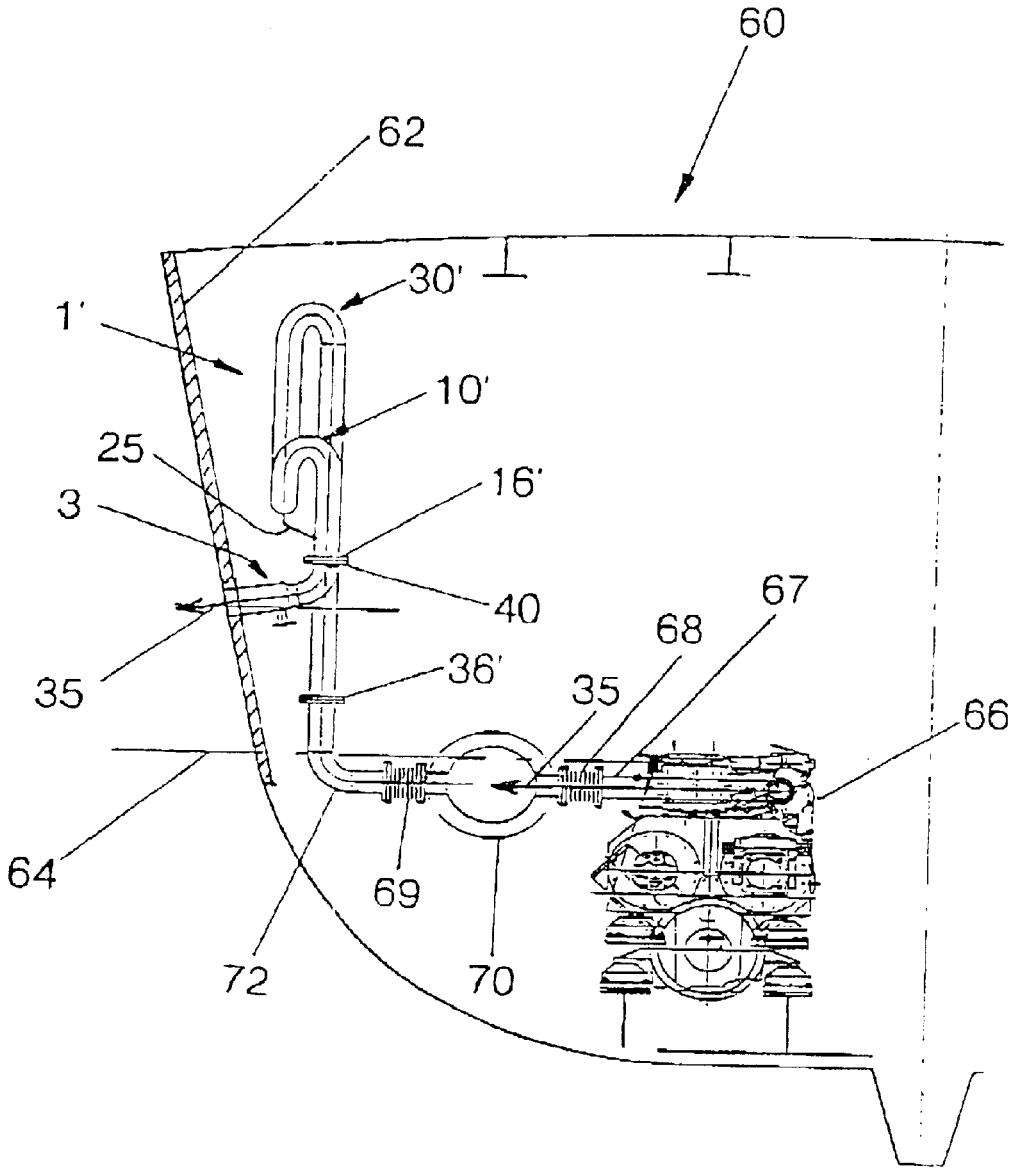

Yet other advantages of the inventions shall be explained in the following with reference to drawings of different embodiments. The drawings show:

FIG. 1 a view of a first embodiment of an exhaust pipe section between the engine and the end member of the exhaust pipe;

FIG. 2 a side elevation view of a second embodiment of said exhaust pipe section;

FIG. 3 a front view of the second embodiment;

FIG. 4 a side elevation view of an end member of the exhaust pipe with a cooling-water jacket;

FIG. 5 a front view of the end member with cooling-water jacket;

FIG. 6 a partial section of the hull, showing an engine and an embodiment of a complete exhaust system.

An exhaust pipe section 1 according to the embodiment in FIG. 1 has the following primary elements when viewed against the direction of exhaust gas flow 35: a flange 16, followed by a straight pipe section 14, a first bend 10 therebehind, a second bend attached thereto, a straight section 28, a U-bend 30 connected thereto and a long straight section 34 therebehind that ends in a further flange 36. The first bend has an upward branch 11 and a downward branch 12. In the same manner, the second bend 20 has a downward branch 21 and a subsequent upward branch 22, and the third bend has an upward branch 31 and a downward branch 32.

The downstream flange 16 serves to connect the end member of the exhaust pipe shown in FIG. 4, while flange 36 connects exhaust pipe section 1 to the engine, or to any silencer or filter element disposed before the engine.

Seawater gushing from outside the vessel through exhaust gas outlet 44 (FIG. 4) into the end member and onward into exhaust pipe section 1 can overcome, on account of its kinetic energy, vertical pipe section 14 and the first bend 10 situated behind it. In the process, owing to contact with the walls in the area of the upward first branch 11 and the downward second branch 12 of bend 10, the water dissipates a large proportion of its kinetic energy. The first bend thus acts as a means for degrading the energy of the seawater. The seawater can then flow either back in the direction of the exhaust gas outlet or into bend 20 located behind bend 10. As a result of the renewed wall contact in downward branch 21 and upward branch 22 of the second bend 20, any remaining energy of the water is degraded to such an extent that it can no longer surmount the subsequent upward section 28 of the exhaust pipe.

In addition to energy degradation, the second bend performs the additional function of a settling basin. The water that collects in the second bend 20 is fed back to a lower-lying part of vertical pipe section 14 through an outflow duct 24 located at the lowest point of the bend and through a downward drainage pipe 25 or similar tube. Drainage pipe 25 has a smaller cross-section than the exhaust pipe, so that seawater gushing into the exhaust pipe can penetrate in smaller quantities at most through drainage pipe 25 into the second bend 20.

In the embodiment shown, bends 10, 20 and 30 each have a 180° angle of curvature, as a result of which the straight pipe sections connected to each of the bends run parallel to each other. As is shown in the embodiments illustrated in FIGS. 1 to 3, it is advantageous to install the exhaust pipe in such a way that the straight pipe sections 14, 28 run vertically, in order to hold back the seawater as effectively as possible. The lengths of the straight pipe sections 14, 28 as well as the transition between bend 10 and bend 20 can be varied according to the space available and according to the arrangement of the engine and the exhaust gas outlet.

The embodiment of exhaust pipe section 1' as illustrated in FIGS. 2 and 3 differs from the embodiment shown in FIG. 1 mainly in respect of two successive 180° bends 10', 20', which curve in the same direction along a helix. In detail, and in this form of construction, exhaust pipe section 1' includes a bend 10' located upstream (the direction of flow is again marked by arrow 35) behind the vertical pipe section 14', wherein said bend is curved outwards in FIG. 2 to behind the plane of the drawing. In this embodiment, bend 10' thus describes half of a counter-clockwise spiral path. Bend 20' directly following bend 10' lies entirely within the plane behind the plane of the drawing and is curved within that plane in the same counter-clockwise way as bend 10'. The subsequent upward pipe section 28' runs vertically upwards and leads into a further bend 30' that is curved back in the direction of the forward plane and is curved in the contrary direction to bends 10', 20'. The downward vertical pipe section 34' that then follows is in the same plane as pipe section 14', as can be seen from FIG. 3, where the two pipe sections are shown one behind the other.

The advantage of this embodiment consists in it being more space-saving in the side elevation view (FIG. 1 and FIG. 2). In a front view (FIG. 3) vertically alongside, this embodiment requires more space, however.

Other embodiments are conceivable in which one or more upstream bends are included before the first bend as viewed in the direction of exhaust gas flow, said additional bend or bends beginning with a first downward branch and ending with a second upward branch. Alternatively, the bends forming the means for energy degradation and defining a screw-like spiral path can also be disposed in an essentially horizontal level, with a settling basin connected upstream thereto. For example, the means for energy degradation can also be in the form of an elbow with minimal radius of curvature and angled downward by 90°. In a totally different configuration, a pipe section of greatly increased cross-section is provided that interrupts or at least slows the flow of seawater gushing in, and which at the same time has a lower point forming a settling basin and having a drainage conduit.

End member 3 of the exhaust pipe, an example of which is shown in FIGS. 4 and 5, follows immediately downstream from straight section 14 or 14' of exhaust pipe section 1, 1' according to one of the aforementioned embodiments, and has a flange 40 at its inlet end. Flange 40 is connected to flange 16 or 16'. In addition, end member 3 has a knee 42 connected to flange 40 and a straight section 43 connected to said knee. The latter straight section is enclosed by a cooling-water jacket 45 as far as exhaust gas outlet 44. The inside wall 48 of cooling-water jacket 45 is formed by the outside wall of straight section 43, the outside wall 49 of cooling-water jacket 45 is a pipe section concentrically surrounding the inside wall 48, and two ring-shaped walls 46 and 47 close the cooling-water jacket 45 at the two ends. Cooling-water jacket 45 also includes a cooling water inlet connector 52, with a flange 53 thereon, as well as a cooling water outlet that be seen in FIG. 5. The latter is formed by a lower hole 54 and upper holes 56 lying along an arc that penetrate the ring-shaped wall 47 and which partially and radially surround the exhaust gas outlet 44. At the downstream end of the cooling-water jacket there is a flange comprised of two spaced-apart plates 57 and 58. When installing end member 3, particularly in watercraft with a side made of wood or glass-fibre composite, the two plates 57 and 58 of the flange are pressed against the side of the watercraft from the outside and inside, such that the cooling-water jacket 45 penetrates the side of the vessel with that part which is in the space 59 between plates 57, 58. In a watercraft with an outer shell made of metal, plate 57 may be omitted. The remaining plate 58 is then welded at its outer periphery to the respective points on the side of the vessel. A distinguishing feature of the invention in each case is that the side of the vessel does not come into direct contact with the exhaust pipe—i.e. with straight section 43 in the embodiment illustrated.

The size and arrangement of holes 54, 56 for the cooling water outlet are chosen for the embodiment in such a way that the greatest proportion of the outflowing cooling water passes through the upper holes 56 and semi-circularly envelops on their upper side the exhaust gases expelled through outlet 44. Thus, according to the method of cooling the exhaust gases pursuant to the invention, the exhaust gases and the cooling water do not mix until they are outside the exhaust system.

It can be seen from FIG. 4 and FIG. 6 that flange 40 is inclined relative to the central axis 39 of the end member. If flange 40 is mounted to a horizontally disposed flange 16, 16' pursuant to the embodiment in FIG. 1 or 2, there is a resultant downward gradient in the end member in the direction of the exhaust gas outlet 44. By this means, the water remaining in the cooling-water jacket 45 after the engine is switched off and hence after the seawater cooling system is switched off can be discharged through the lower hole 54 of the ring-shaped wall 47, said hole thus being at the lowest point of the cooling-water jacket 45.

According to the teaching of the invention, the total cross-section of holes 54 and 56 is sized such that the cooling-water jacket 45 is always entirely filled by inflowing cooling water when the cooling water circulation system conveys the pre-defined amount of water. Depending on the amount of cooling water flowing through the system and the size of the separate holes, the ring-shaped wall 47 can be provided with holes 56 around its entire circumference, for example.

FIG. 6 shows, by way of example, the arrangement of a complete exhaust system inside a hull 60. An engine 66 has an exhaust outlet 67 to which a compensator 35, a silencer 70, a further compensator 69 and a knee 72 leading perpendicularly upward are connected in the direction of flow 35 of the exhaust gases. Following these elements, in the direction of flow, the exhaust pipe section 1' (pursuant to the embodiment shown in FIGS. 2 and 3) is flange-mounted to flange 36'. End member 3 pursuant to the embodiment in FIGS. 4 and 5 is mounted to flange 16' of exhaust pipe section 1' located further downstream. Said end member is connected to the side 62 of the vessel by means of plates 57, 58 that constitute the flange.

In this arrangement, the main bulk of the engine and the elements of the exhaust system located downstream therefrom as far as knee 72 are located below the waterline 64. If seawater were able to penetrate beyond U-bend 30' into the exhaust system, this could no longer be discharged from the exhaust system with the force of gravity alone; in such a case, an active pump system would be needed. Compensators 68 and 69, which are provided in the form of expansion bellows, and silencer 70 form additional niches where seawater can collect and from which the seawater can only be removed with difficulty. The water would not evaporate until it comes into contact with the hot exhaust gases, thus giving rise to an increased risk of corrosion. This would also increase the risk of salting in the low-lying parts of the exhaust system, as a result of which an ever-thicker salt layer would form in the course of time, thus leading to clogging. For this reason, it is particularly important in such an arrangement to prevent seawater penetrating to these parts of the system.

The means for energy degradation, the settling basin, the exhaust pipe and the seawater cooling system upstream before the settling basin are preferably made of 1.4571 or 1.3964 alloyed steel. However, the section of the exhaust pipe which is located upstream from the settling basin may be made of simple carbon steel, due to the fact that no seawater can penetrate this part of the system.

What is claimed is:

1. Exhaust system for a vessel, having an exhaust pipe which leads from an engine system to an exhaust gas outlet, the exhaust system comprising:

a through-flow means for degrading the energy of seawater gushing through the exhaust gas outlet into said exhaust pipe in a section of said exhaust pipe preceding the exhaust gas outlet;

at least one settling basin provided in at least one of the area of said means for degrading the energy of seawater, or upstream thereof in the direction of exhaust gas flow; and a drainage conduit leading from a deepest point of the settling basin into surroundings of the vessel;

wherein the settling basin is disposed higher than the exhaust gas outlet, and wherein the means for degrading energy of seawater is defined by at least one elbow, and the settling basin is defined by a section of the exhaust pipe that is located between a downward section and a subsequent upward section of said exhaust pipe.

2. Exhaust system according to claim 1, wherein the elbow in the pipe is defined by first and second 180° bends that curve in the same direction along a helix.

3. Exhaust system according to claim 2, wherein the first 180° bend closest to the exhaust gas outlet when viewed contrary to the direction of exhaust gas flow comprises a first upward branch and a second downward branch, and wherein the second 180° bend following thereafter defines the settling basin and commences with a first downward branch and ends with a second upward branch.

4. Exhaust system according to claim 2, wherein the transition from the first to the second 180° bend is formed by a straight pipe section.

5. Exhaust system according to claim 2, wherein the drainage conduit is in the form of a downward drainage pipe and connected to that section of the exhaust pipe that is located downstream behind the first 180° bend.

6. Exhaust system according to claim 5, wherein the drainage pipe as a smaller cross-section, at least in part, than the exhaust pipe.

7. Exhaust system according to claim 1, wherein cooling seawater is fed into the exhaust gas downstream from the means for energy degradation.

8. Exhaust system according to claim 7, wherein an end member at the outlet end of the exhaust pipe is surrounded at least in part by a cooling-water jacket.

9. Exhaust system according to claim 8, wherein an inside wall of the cooling-water jacket is defined by an outside wall of the exhaust pipe, the outside wall of the cooling-water jacket concentrically surrounds the inside wall thereof, and the cooling-water jacket is closed at the respective ends by a ring-shaped wall connecting the inside and outside wall of said jacket.

10. Exhaust system according to claim 9, wherein the cooling-water jacket has a cooling water outlet at the opposite end from the exhaust gas outlet, and the cooling water outlet is formed by at least one opening in the ring-shaped wall situated in the area of the exhaust gas outlet.

11. Exhaust system according to claim 10, wherein the exhaust system is led through a corresponding hole in the side of the vessel in the area of the cooling-water jacket.

12. Exhaust system according to claim 11, wherein the cooling-water jacket is provided with a mounting flange for attachment to the side of the vessel.

13. Exhaust system according to claim 10, wherein the cooling water inlet and the cooling water outlet are so designed and disposed that the outward flow of cooling water at least partially envelops the flow of exhaust gas discharged from the exhaust gas outlet of the exhaust pipe.

14. Exhaust system according to claim 13, wherein the cooling water outlet is formed by holes in the outlet wall constituting at least a segment of a circle, the total cross-section and arrangement of said holes being chosen such that the cooling water flowing through the cooling-water jacket constantly fills the entire volume thereof.

15. Exhaust system according to claim 14, wherein the cooling-water jacket is inclined toward the cooling water outlet and at least one of the holes of the cooling water outlet is located at the lowest point of the cooling-water jacket.

16. Exhaust system according to claim 1, wherein a U-bend is located in the exhaust pipe on the other side of the settling basin from the exhaust gas outlet against the direction of flow of the exhaust gases, said U-bend having a first upward branch and a second downward branch.

17. Exhaust system according to claim 16, wherein the transition from the settling basin, from the second 180° bend to the U-bend is formed by a straight pipe section.

18. Exhaust system according to claim 17, wherein the straight pipe section between the bends is vertical.

* * * * *